United States Patent [19]

Karp et al.

[11] 4,409,518

[45] Oct. 11, 1983

[54] TWT INTERACTION CIRCUIT WITH BROAD LADDER RUNGS

[75] Inventors: Arthur Karp, Palo Alto, Calif.; Gary A. Biggs, Sandy, Utah

[73] Assignee: Varian Associates, Inc., Palo Alto, Calif.

[21] Appl. No.: 287,954

[22] Filed: Jul. 29, 1981

[51] Int. Cl.[3] ..... H01J 25/34

[52] U.S. Cl. ..... 315/3.5; 333/256; 315/3.6; 315/39.3

[58] Field of Search ..... 333/256; 315/3.5, 3.6, 315/39.3

[56] References Cited

U.S. PATENT DOCUMENTS

| | | | |
|---|---|---|---|
| 2,827,588 | 3/1958 | Guenard et al. | 315/3.5 |
| 2,920,227 | 1/1960 | Dohler et al. | 315/3.5 |
| 2,942,142 | 6/1960 | Dench | 315/3.5 |
| 3,171,086 | 2/1965 | Gerlach | 315/3.5 |
| 3,387,234 | 6/1968 | Sobotka | 315/3.5 |

FOREIGN PATENT DOCUMENTS

| | | | |
|---|---|---|---|
| 64659 | 6/1955 | France | 315/3.5 |
| 512506 | 6/1976 | U.S.S.R. | 315/3.5 |
| 573825 | 9/1977 | U.S.S.R. | 315/3.5 |

*Primary Examiner*—Saxfield Chatmon, Jr.
*Attorney, Agent, or Firm*—Stanley Z. Cole; Peter J. Sgarbossa; Richard B. Nelson

[57] ABSTRACT

A slow-wave circuit suitable for a high-frequency traveling-wave tube has an array of metallic ladder rungs extending transversely across an elongated envelope and not in contact with the envelope except at the ends of the rungs. The envelope has a cross-shaped section to provide a fundamental backward wave. The rungs preferably have aligned apertures to pass a beam of electrons in traveling-wave interaction with the circuit.

By making the rungs transversely broader than a critical value, the lowest passband of the circuit has poles of impedance at both its ends, whereby more efficient interaction is obtained, along with greater stability.

13 Claims, 11 Drawing Figures

TWT INTERACTION CIRCUIT WITH BROAD LADDER RUNGS

The Government has rights in this invention pursuant to Contract F30602-79-C-0172 awarded by the Department of the Air Force.

DESCRIPTION

FIELD OF THE INVENTION

The invention pertains to slow-wave circuits as used in traveling-wave tubes. A familiar form of such circuits is a metallic ladder structure, the rungs forming the periodic interaction elements connected across a metallic envelope.

SUMMARY OF THE INVENTION

A purpose of the invention is to provide a slow-wave circuit for a traveling-wave tube (TWT) which provides a high interaction impedance over a useful band of frequencies.

A further purpose is to provide a circuit for very high frequencies which is easy to manufacture to precise tolerances.

A further purpose is to provide a circuit propagating a fundamental backward wave eventually leading to design dimensions that provide good heat dissipation.

These purposes are achieved by a metallic ladder structure, the envelope space beside the rungs having a T-shaped cross section to provide a fundamental backward-wave propagation characteristic. When operating in the first forward-wave space-harmonic regime, the rungs have a thickness sufficient to be mechanically strong and conduct heat adequately. The breadth of the rungs is at least one-half their length, whereby in the lowest-frequency passband there is a pole of impedance at each bandedge. Thus the interaction impedance is maintained high across a wider range of operating frequencies, and is made low at the band edge of the next higher passband, whereby instability in this band is avoided.

PRIOR ART

Figure 1:
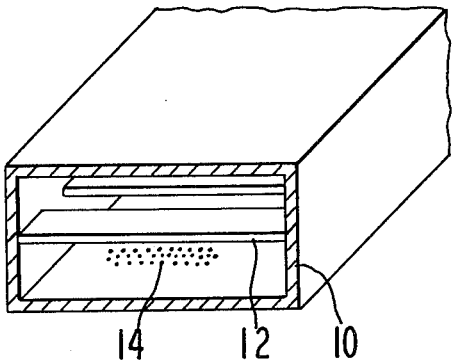
FIG. 1 PRIOR ART
FIG. 1 is an isometric view of a prior-art basic ladder circuit.

A basic ladder-based TWT interaction circuit is shown in FIG. 1. It is a hollow rectangular waveguide 10 having a spaced array of ladder rungs 12 across its midplane. A flat beam of electrons 14 is projected axially down the waveguide in proximity to rungs 12 which form the periodic interaction elements of the circuit. This circuit has been known as the "Easitron" (because it was thought to be easy to build). It provides zero bandwith, however, so is suitable only for a fixed-frequency oscillator.

Figure 2:
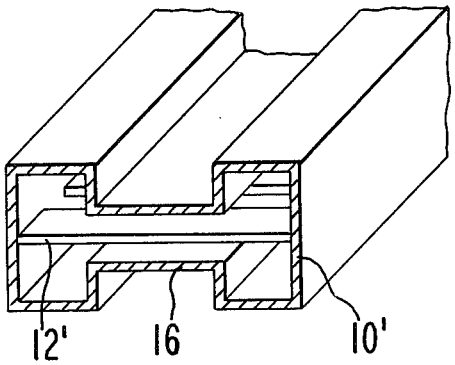
FIG. 2 PRIOR ART
FIG. 2 is an isometric view of a prior-art ladder circuit supporting a fundamental forward wave.

FIG. 2 shows a modification of the circuit of FIG. 1 identifiable as a variant of the circuit known as the "Karp circuit". By providing capacitive-loading ridges 16 near the center of the rungs 12', a circuit with moderate bandwidth is produced. However, its fundamental wave is a forward wave, so for synchronous interaction with a fixed-velocity electron beam over a range of frequencies, the phase shift, $\beta P$ per periodic length must be in the range between 0 and $\pi$ radians. If very high microwave frequencies such as 10 to 100 GHz are to be amplified, the necessarily short period makes the rung cross-section so small that the rungs are incapable of handling much power and are very difficult to manufacture. An amplifier design based on $2\pi < \beta\rho < 3\pi$could be considered instead; the rungs would come out much more robust, but the gain would be very low because a high-order space-harmonic regime would be involved.

Figure 3A:
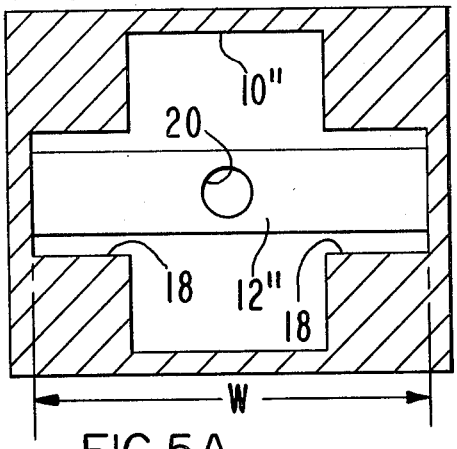
FIG. 3A PRIOR ART
FIGS. 3A and 3B are a cross section and an axial section of a prior-art ladder circuit supporting a fundamental backward wave.
Figure 3B:
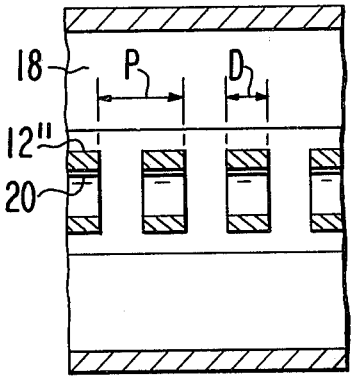
FIG. 3B PRIOR ART

The prior-art ladder-based circuit of FIGS. 3 is loaded in an opposite sense. Instead of one or two capacitive loading ridges 16 at the center of the rungs, there are pairs of inductive-shielding protrusions 18 localized near the outer ends of rungs 12'' where rf magnetic fields are high. This produces a fundamental backward-wave characteristic as illustrated in the $\omega$-$\beta$ diagram of FIG. 4. To interact synchronously with a constant-velocity electron beam over a range of frequencies, the phase shift per period P must be between $\pi$ and $2\pi$ radians. The greater periodic length P permits increased thickness D of the rungs 12''. In fact, greater thickness is required because the beam interacts with the first forward space-harmonic of the circuit wave, and so should be well shielded when inside the rung from the fields of the wave during the part of the cycle when the wave is in the wrong phase. The net result is a rung thickness D much greater than is generally possible with the forward-wave circuit of FIG. 2. Nor has the rung been made so thick that a very high-order space-harmonic interaction regime and consequently very low gain is implied. Greater heat dissipating capacity and increased ruggedness are obtained. To obtain the coupling between the wave and the beam, a cylindrical beam is projected through holes 20 in rungs 12''.

Figure 4:
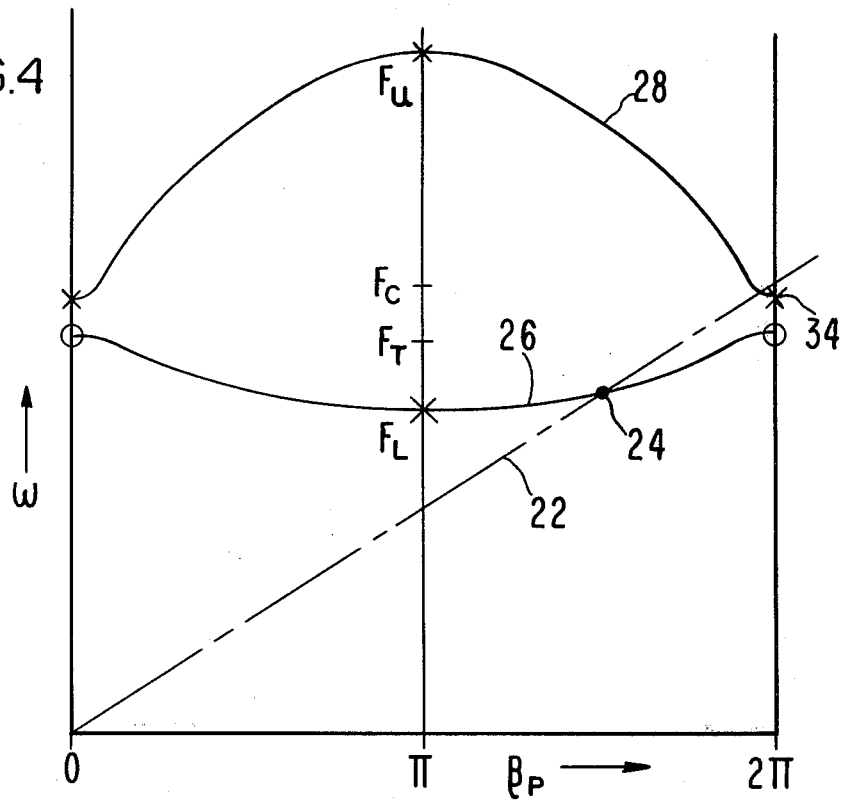
FIG. 4 is the $\omega$-$\beta$ Brillouin diagram of the circuit of FIGS. 3.

The $\omega$-$\beta$ diagram of FIG. 4 illustrates the phase characteristics of the prior-art circuit of FIGS. 3. The frequency $\omega$ is plotted vertically vs the phase shift per period $\beta P$. The slope of straight line 22 represents the constant velocity of the electron beam. Near-synchronous interaction is obtained at frequencies near that at the intersection 24 of velocity-line 22 and the curve 26 of the phase-shift per period in the lowest passband. At the band edges $F_L$ and $F_T$ the interaction impedance of the circuit assumes critical values. The impedance is a measure of the axial component of rf electric-field strength in the direction of electron flow. At the lower ($\pi$) end $F_L$ of band 26 there is a pole of interaction impedance indicated by a cross. The electric fields are all axial, and also extra strong in magnitude, for a given power flow, relative to the situation at non-band-edge frequencies. At the upper ($2\pi$) end $F_T$ there is a zero of interaction impedance indicated by a circle. Here the electric fields are strong but entirely transverse. The practical significance of this is that at frequencies approaching $F_T$ the impedance becomes increasing lower and the gain and efficiency of the TWT suffer. Also, the higher-frequency passband represented by curve 28 has an impedance pole 34 at its lower cutoff frequency $F_C$ and $2\pi$ phase shift. Velocity line 22 intersects phase-shift line 28 near this pole, indicating synchronous interaction with the high-impedance circuit wave. This makes unwanted oscillation likely at this point.

Figure 5A:
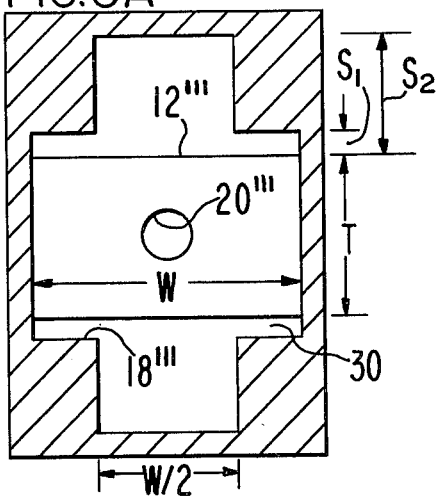
FIGS. 5A and 5B are a cross section and an axial section of a circuit embodying the invention.
Figure 5B:
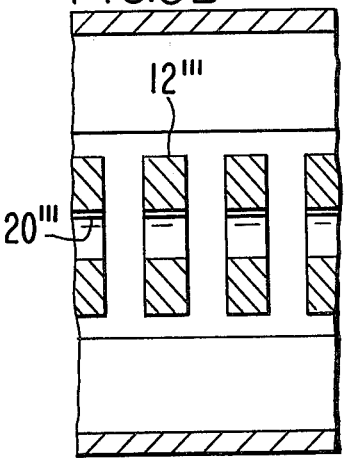

FIGS. 5A and 5B are an end view and an axial section of a slow-wave circuit embodying the invention. The breadth T of ladder rungs 12''' is increased substantially over that in the prior-art circuit of FIGS. 3. However, rungs 12''' do not abut waveguide protrusions 18''', there being at least a narrow slot 30 between them. If there were no such slot, there would be more edges along which brazing would be needed, promoting the likelihood of circuit defects due to excess or deficiency of solder. Rungs 12''' are still negative-inductively loaded by protrusions 18''' and not short-circuited by them. Dimension $S_2$ should invariably be several times $S_1$.

Figure 6:
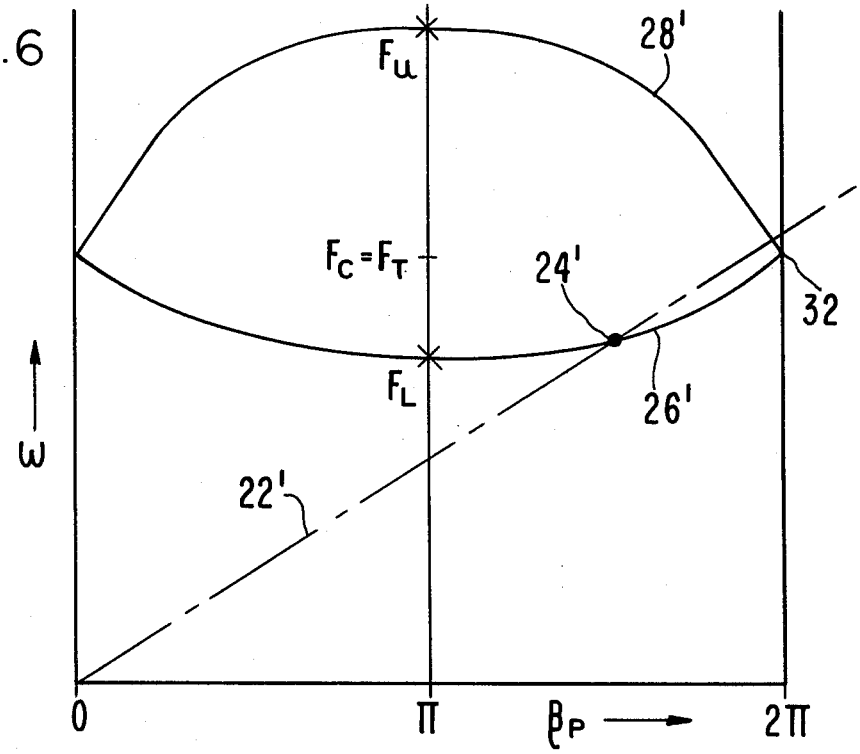
FIG. 6 is the $\omega$-$\beta$ diagram for a circuit modified from that of FIGS. 5, and also embodying the invention.
Figure 7:
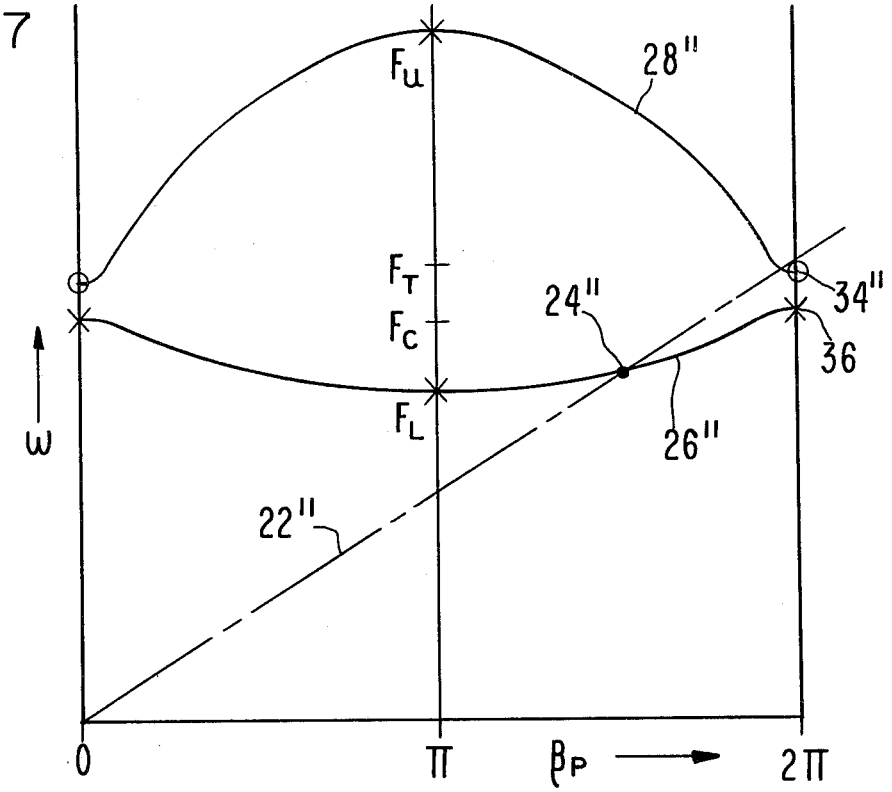
FIG. 7 is the $\omega$-$\beta$ diagram for the circuit of FIGS. 5.

Exact mathematical analysis of the more complex structures used as slow-wave circuits is usually not possible. Generally, the propagation characteristics are determined by measurements on a "cold-test" model of a segment of the circuit. FIG. 6 is an experimentally measured $\omega$-$\beta$ diagram for a circuit with a critical rung breadth T intermediate between that of the prior-art circuit of FIGS. 3 and that of the inventive circuit of FIGS. 5. For this critical value of thickness the higher band-edge frequency $F_T$ of the lower passband 26' becomes equal to the lower bandedge frequency $F_C$ of the upper passband 28'. The condition is known as "coalesced passbands". The two branches of the $\omega$-$\beta$ diagram appear to cross each other at the common bandedge point $F_C=F_T$. The coalesced-passband condition is often useful for TWT's of the type considered, because the interaction impedance remains high at 24', but it is low at the coalescing point 32, so that unwanted oscillation near 32 is discouraged. The discussion of coalesced passbands is given here to illustrate that as one increases the rung breadth T an entirely new and different kind of effect is introduced. The most useful range of the new effect is obtained when the rung breadth T is increased to or beyond the critical value required for coalescing as in FIG. 6. This useful value has been found to be generally greater than one-half the span W of the rungs 12'''. The more general $\omega$-$\beta$ diagram for a circuit with these inventive dimensions is shown in FIG. 7. The two passbands 26'' and 28'' have about the same shapes as for the prior-art circuit of FIG. 4. However, a change of kind has occurred as the circuit is transformed relative to the coalescing point. The pole of impedance 34 that was at the lower bandedge $F_C$ of the higher passband 28 has been transferred to the upper bandedge point 36 of the lower passband 26''. The zero of curve 26 has likewise been transferred to upper passband 28'', all at $\beta\rho=2\pi$. The result of this remarkable transformation is that the interaction impedance is now high at both edges of the useful lower passband, and is consequently more elevated in between. Thus efficiency and gain of a TWT are enhanced.

A further essential benefit of the inventive structure involves stability of the TWT. With the prior-art circuit of FIGS. 3 and 4, the velocity line 22 comes very close to or intersects the upper passband curve 28 near its lower cutoff point 34. This point in the prior art corresponds to a pole of impedance, so the TWT is prone to oscillate in the upper passband 28 near its cutoff frequency $F_C$. With the inventive circuits of FIGS. 5, 6 and 7, however, cutoff point 34'' of upper passband 28'' corresponds to a zero of interaction impedance, so instability at this frequency is much less likely. Alternatively, "coalescence" point 32 corresponds to a finite low value of interaction impedance, equally well protecting against instability.

Figure 8:
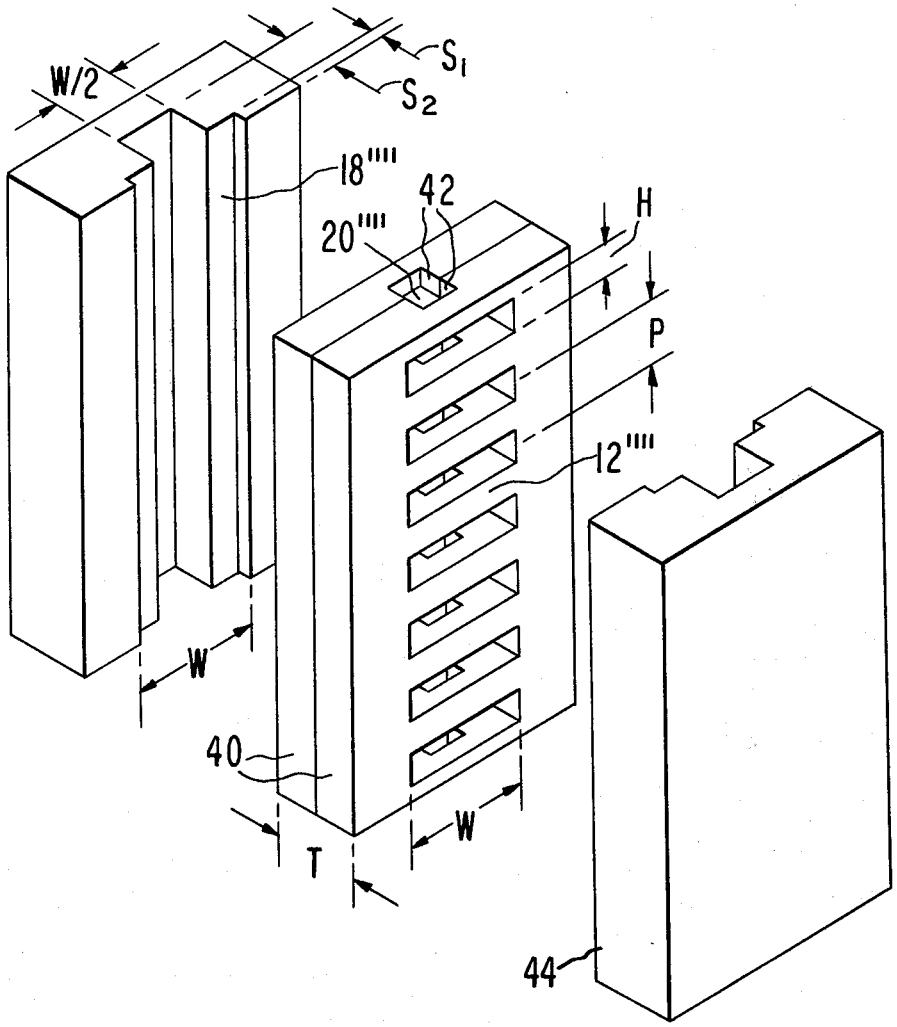
FIG. 8 is an isometric view illustrating a method of construction of the circuit of FIGS. 5.

FIG. 8 illustrates a method of construction for ladder-based circuits which may embody the invention. The parts of the circuit are preferably of oxygen-free high-conductivity copper (OFHC). For very high microwave frequencies (millimeter waves) the circuits are very small and delicate and may be formed, e.g., by electric-discharge machining (EDM) of rectangular perforations in a simple copper slab. In FIG. 8, a pair of half-ladders 40 are formed from copper slabs, each half containing notches 42 which when aligned will form the beam-passage apertures 20''''. The notches may equally well be half-round rather than half-square; it is essentially immaterial whether the tunnel cross-section is round or square. Half-ladders 40 are assembled between two cover plates 44 having the non-contacting loading protrusions 18'''', with dimension $S_2$ at least several times $S_1$ (FIG. 5A). The four pieces are assembled as by brazing or sintering to form the ladder-based circuit and its vacuum envelope. Alternatively, instead of two half-ladders, a single slab could be cut into the desired ladder if the slab is obtained with a round tunnel already in it, as by casting molten copper around a stretched steel wire and later removing the wire by pulling or with acid.

The aforementioned brazing or sintering provides annoying opportunities for circuit defects to occur. If there is too much flow of metal, internal dimensions are disturbed. If too little, circuit resistance (loss) develops. It is a valuable contribution of the present invention that the need for brazing to any of the 4 edges of any of the numerous ladder rungs is avoided by design. Instead, only four longitudinal seam brazes are needed just outside the rung/perforation region.

Figure 9:
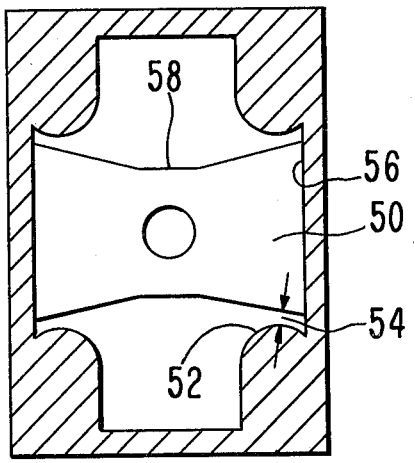
FIG. 9 is a cross section of a somewhat different embodiment.

FIG. 9 is an end view of a somewhat different embodiment of the invention, illustrating that the circuit may have a variety of shapes. The tapered ladder rungs 50 may have better thermal conduction than rungs of uniform cross section. The loading protrusions 52 are rounded, giving non-uniform spacing from rungs 50. All that is required is that the spacing 54 near the rung ends 56 be much smaller than that near the rung middle 58.

It will be obvious to those skilled in the art that many variations of the circuit may be made within the scope of the invention. The above examples are intended to be illustrative and not defining. The rungs need not be of uniform cross section but may be tapered or stepped. The loading protrusions need not be rectangular but may have a wide variety of shapes as long as the spacing from the rungs is smaller near their ends than near their middles. The scope of the invention is to be limited only by the following claims and their legal equivalents.

What is claimed is:

1. A slow wave circuit comprising:

a conductive envelope extended in an axial direction, and defining interior walls;

an array of parallel conductive rungs spaced along the length of said envelope, each rung connected only at its ends to said envelope at opposite ones of said interior walls;

the improvement wherein at least a remaining one of said interior walls of said envelope is shaped so that the spacing between said remaining wall and each said rung near at least one of said rung ends is smaller than the spacing between said wall and rung near the middle of each said rung, and the breadth of at least a portion of said rungs, in a direction perpendicular to the length of said rungs and to said axial direction is greater than one-half the length of said rungs, whereby the fundamental wave of said lowest passband is a backward wave, and the upper cutoff frequency of the lowest passband of said circuit corresponds to a pole of the impedance of said circuit in said axial direction.

2. The circuit of claim 2 wherein the space between said one wall and said rungs has a T-shaped cross section perpendicular to said axial direction.

3. The circuit of claim 1 further including a set of apertures through said rungs aligned to form an open channel in said lengthwise direction whereby a beam of charged particles may pass through said circuit for traveling-wave interaction therewith.

4. The circuit of claim 1 wherein at least one of said rungs is separated into a pair of opposed posts by a gap near its midpoint.

5. The circuit of claim 1 wherein said breadth of said rungs varies along their length and wherein the maximum thickness in said direction perpendicular to their length and to said axial direction is near said ends of said rungs.

6. A slow wave circuit having a fundamental backward wave characteristic comprising:

a conductive envelope extended in a longitudinal direction;

an array of conductive rungs spaced along the length of said envelope, each rung connected only at its ends to two opposite sides of said envelope;

the improvement wherein each rung defines a generally straight axis and the breadth of at least a portion of said rungs in a direction perpendicular to the length of said rungs and to said longitudinal direction is at least as great as the thickness required to coalesce the two lowest frequency passbands of said circuit.

7. The circuit of claim 6 wherein at least one wall of said circuit is shaped so that the spacing between said wall and said rungs near at least one end of said rungs is smaller than the spacing between said wall and said rungs near the middle of said rungs, whereby the fundamental wave of said lowest passband is a backward wave.

8. A slow wave circuit as in claim 1 in which said rungs define a generally straight axis.

9. A slow wave circuit as in claim 8, in which said rung has a cross section which is greater at the ends of the rungs than at points intermediate said ends.

10. A slow wave circuit as in claim 6 in which said rung has a greater cross section near the ends thereof than at points intermediate said ends.

11. An improved slow wave circuit having a fundamental backward wave characteristic, comprising:

a conductive envelope extended in an axial direction and defining an interior wall;

an array of conductive rungs spaced along the length of said envelope, each rung connected only at its ends to two opposite sides of said envelope;

the spacing between said wall and said rungs near at least one end of said rungs being smaller than the spacing between said wall and said rungs near the middle of said rungs;

and the breadth of at least a portion of said rungs in a direction perpendicular to the length of said rungs and to said axial direction being at least as great as the thickness required to coalesce the two lowest frequency passbands of said circuit.

12. A circuit as in claim 11, in which each of said rungs defines a generally straight axis, and each said rung is symmetrical about said axis.

13. A circuit as in claim 12, in which said rungs are spaced similarly from opposite interior walls of said envelope.

* * * * *